US007000448B2

(12) United States Patent
Hamm et al.

(10) Patent No.: US 7,000,448 B2
(45) Date of Patent: Feb. 21, 2006

(54) COMPRESSION TOOL JAWARM MEMBER

(75) Inventors: James E. Hamm, Grafton, OH (US); James E. Smolik, Westlake, OH (US); Jason M. Smith, Tiffin, OH (US)

(73) Assignee: Emerson Electric Co., St. Louis, MO (US)

( * ) Notice: Subject to any disclaimer, the term of this patent is extended or adjusted under 35 U.S.C. 154(b) by 416 days.

(21) Appl. No.: 10/364,008

(22) Filed: Feb. 12, 2003

(65) Prior Publication Data

US 2004/0154371 A1 Aug. 12, 2004

(51) Int. Cl.
*B21D 39/00* (2006.01)

(52) U.S. Cl. ..... 72/409.01; 72/416; 72/453.16; 81/300

(58) Field of Classification Search ..... 72/409.01, 72/409.1, 409.19, 416, 407, 453.16; 29/237; 81/300, 342, 348–350, 427.5
See application file for complete search history.

(56) References Cited

U.S. PATENT DOCUMENTS

| | | | | |
|---|---|---|---|---|
| 2,766,631 A | * | 10/1956 | Van Sittert | 74/110 |
| 3,554,000 A | * | 1/1971 | Schwab | 72/453.15 |
| 5,148,698 A | | 9/1992 | Dischler | |
| 5,295,831 A | * | 3/1994 | Patterson et al. | 433/141 |
| 5,307,664 A | * | 5/1994 | Homm | 72/401 |
| 6,035,775 A | | 3/2000 | Nghiem | |
| 6,112,418 A | * | 9/2000 | Strater | 30/340 |
| 6,434,998 B1 | * | 8/2002 | Amherd | 72/416 |

FOREIGN PATENT DOCUMENTS

| | | |
|---|---|---|
| CH | 687 368 A5 | 11/1996 |
| DE | 93 14 054.1 | 1/1994 |
| DE | 196 31 019 A1 | 8/1997 |
| DE | 198 54 943 A1 | 2/1999 |
| DE | 299 08 622 U1 | 9/1999 |
| DE | 101 01 440 A1 | 7/2001 |
| DE | 101 06 363 C1 | 6/2002 |
| DE | 102 00 258 | 7/2003 |
| EP | 1 034 896 A1 | 9/2000 |
| EP | 1 231 027 A2 | 8/2002 |

* cited by examiner

*Primary Examiner*—Daniel C. Crane
(74) *Attorney, Agent, or Firm*—Fay, Sharpe, Fagan, Minnich & McKee, LLP

(57) ABSTRACT

A pivotal jawarm for a compression tool has opposite sides, a pivot pin opening therethrough, longitudinally opposite ends on longitudinally opposite sides of the opening, and inner and outer edges between the ends and on laterally opposite sides of the opening. A stress concentrator comprising aligned recesses in the opposite sides of the jawarm extends from the inner edge toward the pivot pin opening and provides a failure point at the inner edge for consistently initiating a fatigue crack at the failure point and fracture of the jawarm from the failure point to the pivot pin opening.

83 Claims, 7 Drawing Sheets

COMPRESSION TOOL JAWARM MEMBER

BACKGROUND OF THE INVENTION

This invention relates to the art of compression tools for joining pipes and couplings and, more particularly, to an improved pivotal jawarm member for a compression tool.

Compression tools for joining tubes or pipes and coupling components are well known as shown, for example, in U.S. Pat. No. 6,035,775 to Nghiem. Such tools include a compression jaw set removably mounted on a drive mechanism by which the jawarms of the set are displaced into compression about a pipe and coupling to join the latter. More particularly, the jaw set is comprised of a pair of jawarm members pivotally mounted between a pair of side plates and having inwardly open opposed jaw recesses at one end and laterally inwardly facing cam surfaces at the opposite ends. The jawarms are pivotal about pins located in openings through the jawarms between the opposite ends thereof, and the jaw set is mountable on the drive mechanism by means of the side plates and at a location relative to the jaw set which is laterally between the pivot pins and between the pivot pins and cam surfaces of the jaw members. The drive mechanism includes cam rollers which are displaceable axially forwardly and rearwardly along the cam surfaces of the jaw members, and when displaced forwardly of the cam surfaces, engage the latter and displace the opposed jaw recesses toward one another and constrictably about a pipe and coupling interposed therebetween.

The jawarm members have laterally inner and outer edges between the opposite ends thereof and, during operation of the jaw set to compressibly join a pipe and coupling, the area of the jawarm member between the pivot pin opening and inner edge and between the jaw recess and cam surface along the inner edge is under tension and the area laterally outwardly thereof is under compression. The side plates are also stressed during operation of the jaw set in that pivotal displacement of the jawarm members about the pivot pins to produce compressive engagement between the jaw recesses imposes laterally outwardly directed forces through the pivot pins to the side plates. At some point during the life of the jaw set, failure will occur and, preferably, will occur in at least one of the side plates. Failure in a side plate is preferred in that, heretofore, the location of a failure in a jawarm member and the direction of fracture thereafter was unpredictable. More particularly in this respect, failure in a jawarm member typically occurred either between a jaw recess and outer side of the jaw member forwardly of the pivot pin opening or between the inner and outer sides at one or more locations rearwardly of the pivot pin opening. Such failures most often result in separation of the jawarm members into distinct pieces and, in an effort to maintain the pieces together following breakage, strap arrangements have been incorporated in the jaw sets and fastened, for example, to the outer sides of the jawarm members so as to retain separated parts of a jaw member in the jaw set environment following a failure. The strap approach to parts retention is expensive and renders the jawarm members as well as the jaw set using such strapped members structurally complex.

One manufacturer of jawarm members for compression tools alleged to have developed a heat treatment process that prevented the separation of a jawarm into pieces upon failure. In this respect, a fracture of the arm from the inner side toward the outer side thereof allegedly resulted in the material of the arm adjacent the outer side acting as a hinge between the arm parts on opposite sides of the line of fracture. Thus, instead of entirely separating, the parts allegedly remained interconnected following breakage. A number of the latter jawarms were tested for determining the veracity of the alleged non-separating effect. These jawarms, which are shown in U.S. Pat. No. 6,434,998 to Amherd, include a spring and pin recess along the inner edge, for a jaw set using the jawarms to accommodate a torsion spring arrangement therebetween, and a mounting pin clearance recess spaced rearwardly from the spring and pin recess. As the result of testing 38 of the foregoing jaws of different sizes, it was noted that a majority of the jaw members of each size failed from the spring and pin recess to the pivot pin opening through the jaw member. However, the location of failure was still unpredictable in that failures in from about 14% to 25% of each of the different sizes of jawarms tested occurred at the mounting pin clearance recess and across the jawarm arm to the outer side thereof. Moreover, in most of the jawarms tested, the failure at the mounting pin clearance resulted in breakage of the arm into separate pieces. Accordingly, there was no consistency with regard either to predictability of the location of jaw failure or control of the point of failure along the jawarm and direction of the line of fracture from the point of failure.

SUMMARY OF THE INVENTION

In accordance with the present invention, a jawarm is provided with a stress concentrator along the inner edge thereof and in the area of the jawarm which is under tension during use. The stress concentrator is structured and oriented relative to the inner and outer edges of the jawarm to provide a failure point at the inner edge for consistently initiating a fatigue crack at the failure point and fracture of the jaw member along a predictable path from the failure point toward the outer edge of the jawarm. Consistently, as used herein with respect to the failure point, means a single point along the inner side of a jawarm at which a fatigue crack will initially occur for each and every failure of a jawarm. Preferably, though not necessarily, a jawarm member provided with a stress concentrator in accordance with the invention can be produced so as to provide a hinge effect at the outer end of the line of fracture so as to maintain the parts of the jawarm on opposite sides of the line of fracture against total separation. It is also preferred, though not necessary, to locate and orient the stress concentrator relative to the inner edge and pivot pin opening through the jawarm so that the line of fracture is directed to the pin opening. This control of the fracture is of advantage in that the pin opening provides the terminal end for the fracture, whereby the portion of the jaw member between the pivot pin opening and outer edge provides a hinge effect. The pivot pin opening, as part of the fracture line, provides a more predictable reaction between the adjacent parts of the jawarm as they are displaced relative to the hinge area. Even if the hinge effect is not achieved, the pin opening provides predictability with respect to the reaction between the jaw parts in connection with failure across the outer portion of the jawarm.

A stress concentrator in accordance with the invention can have any one of a variety of structural profiles and is oriented relative to the inner and outer edges of a jawarm to promote fracture along a predictable path across the jawarm. The stress concentrator is produced by removing material from the jawarm, either during or after production thereof, so as to provide a predetermined failure point at the inner edge of the jawarm for consistently initiating a fatigue crack at the failure point. As mentioned above, the stress concentrator is oriented relative to the inner and outer edges for the fracture of the jawarm to be along a predictable path there across from the failure point. A preferred stress concentrator meeting this criteria is provided by a recess or channel in one or the other or both of the opposite sides of a jawarm and directed from the inner edge toward the outer edge thereof. The recess or recesses have a depth relative to the corresponding side of the jawarm to provide a failure point of the inner edge at which each and every failure of the jawarm will be initiated. By extending the recess or recesses toward the outer side of the jawarm, control of the path of fracture across the arm is optimized. Stress concentrator profiles having the foregoing criteria for consistently providing a failure point at the inner edge of a jaw member include an arcuate recess in the inner side edge having a depth inwardly of the side edge for consistently providing the failure point and having an axis bisecting the arc of the recess and directed across the jawarm toward the outer edge thereof to provide predictability with respect to the direction of the line of fracture across the arm. Other profiles include a sawcut into the jawarm from the inner edge toward the outer edge, a rectangular notch in the inner edge, a V-shaped notch in the inner edge with the vertex thereof directed toward the outer edge, a bore into the jaw member from the inner edge toward the outer edge and between the opposite sides thereof, and a bore or hole through the jawarm between the opposite sides thereof.

The stress concentrator can be located relative to the jawarm so as to be at least partially visible, and this advantageously provides an operator of the crimping mechanism with a visual indication of an impending failure of the jawarm. Preferably, either the material of the jawarm and/or the manufacturing process with respect thereto provides for the outer portion of the arm ahead of the fracture line to act like a hinge by which the adjacent parts of the jawarm remain connected together upon failure. It is also preferred, as pointed out hereinabove, to have the stress concentrator oriented for the line of fracture of the jawarm to be from the failure point at the inner edge to the pivot pin opening through the arm, whereby the hinge area is provided by the material of the arm between the pin opening and outer edge of the arm.

It is accordingly an outstanding object of the present invention to provide a pivotal jawarm for a compression tool in which the location and direction of failure of the jawarm resulting from use is consistently predictable and controllable.

Another object of the invention is to provide a pivotal jawarm of a compression tool with a single, controllable failure point along the inner edge thereof for consistently initiating a fatigue crack at the failure point and fracture of the jaw member from the failure point toward the outer edge of the arm.

A further object is the provision of a jawarm of the foregoing character wherein the predictability and control of failure or breakage is achieved without compromising functions such as cam surface wear.

Still another object is the provision of a jawarm of the foregoing character which, in connection with failure thereof, can avoid the need for straps to keep the jawarm parts from completely separating from one another.

Yet a further object is the provision of a jawarm of the foregoing character with a stress concentrator having a profile and orientation relative to the inner edge of the jaw member to consistently initiate failure at a failure point along the inner edge and fracture of the jawarm from the failure point to the pivot pin opening therethrough.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
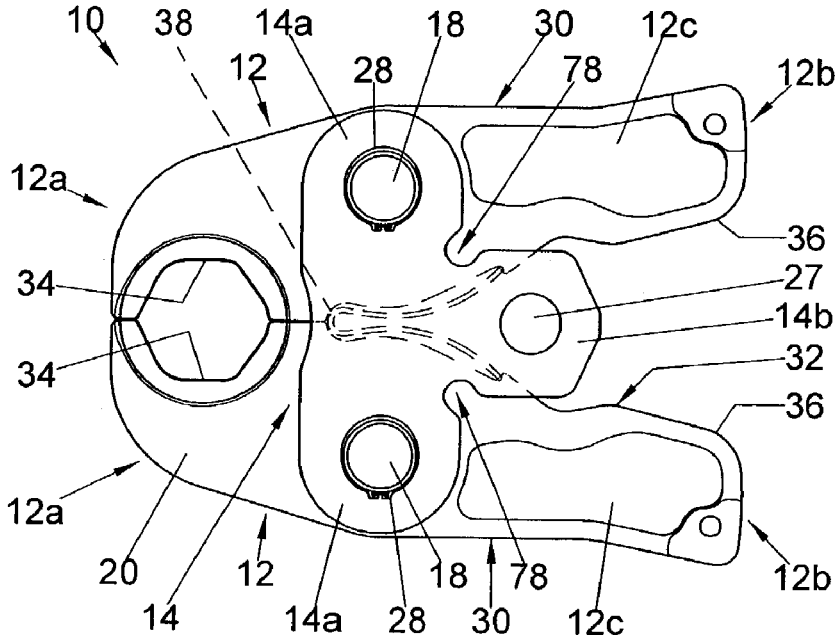
FIG. 1 (PRIOR ART)
FIG. 1 is a plan view of a prior art jaw set including pivotal jawarms of the character to which the present invention is directed.
Figure 2:
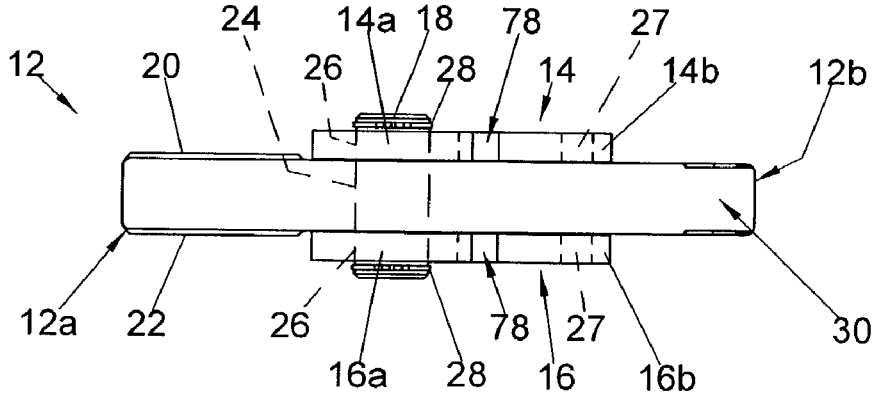
FIG. 2 (PRIOR ART)
FIG. 2 is a side elevation view of the jaw set in FIG. 1.
Figure 3:
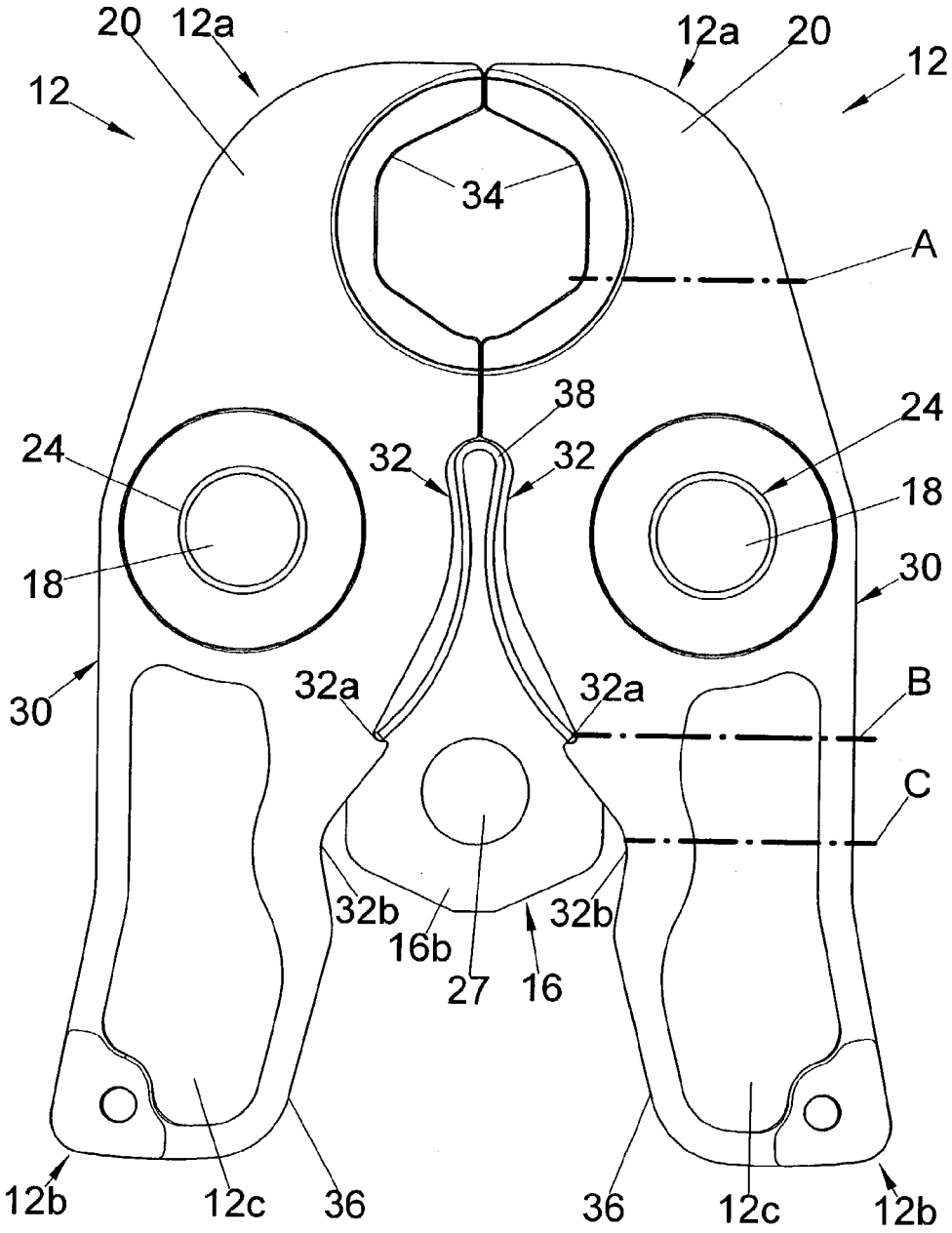
FIG. 3 (PRIOR ART)
FIG. 3 is a plan view of the jaw set shown in FIG. 1 with the top side plate removed and showing typical areas of failure of a prior art jawarm.

Referring now in greater detail to the drawings, wherein the showings are for the purpose of illustrating preferred embodiments of the invention only, and not for the purpose of limiting the invention, FIGS. 1–3 illustrate a prior art jaw set 10 comprising a pair of jawarm members 12 mounted, in the orientation shown in FIGS. 1–3 between top and bottom side plates 14 and 16, respectively, by a corresponding pivot or bearing pin 18. More particularly in this respect, each of the jawarm members 12 has a top side 20 and a bottom side 22 and a pin opening 24 therethrough for receiving the corresponding pin 18. Side plates 14 and 16 are generally T-shaped and include laterally opposite sides 14*a* and 16*a*, respectively, which are provided with aligned holes 26 for receiving the outer ends of the corresponding pin 18. Side plates 14 and 16 further include rear ends 14*b* and 16*b*, respectively, which are provided with aligned openings 27 therethrough which are adapted to receive a mounting pin by which the jaw set is mounted on a drive unit in a well-known manner. The jawarm members and side plates are retained in assembled relationship by spring clips. 28 at the opposite ends of each of the pins 18.

Each of the jawarm members 12 has longitudinally opposite front and rear ends 12*a* and 12*b*, respectively, and top and bottom sides 20 and 22 are recessed rearwardly of pin opening 24 as indicated by numeral 12*c* with respect to top side 20 in FIGS. 1 and 3. Each jawarm further includes laterally outer and inner edges 30 and 32, respectively, which are spaced from opening 24 and which extend forwardly and rearwardly of the opening. Inner edges 32 of the jawarm members provide laterally inwardly open opposed jaw recesses 34 at front ends 12*a* and forwardly of side plates 14 and 16, and laterally inwardly facing cam surfaces 36 at rear ends 12*b* and rearwardly of rear ends 14*b* and 16*b* of the side plates. Inner sides 32, laterally inwardly of pin openings 24, receive and support a hairpin-shaped spring 38 which biases jawarm members 12 in opposite directions about pins 18 to bias jaw recesses 34 laterally inwardly toward one another. Inner sides 32 further include spring retaining shoulders 32*a* and mounting pin clearance recesses 32*b* which respectively engage the free ends of spring 38 and provide a mounting pin clearance when rear ends 12*b* are displaced toward one another to open jaw recesses 34.

In use, jaw set 10 is mounted on a drive mechanism in a well-known manner by means of a pin which is attached to the drive mechanism and received in side plate openings 27. Ends 12*b* of the jawarm members are then manually displaced toward one another to pivot the arm members about pins 18 against the bias of spring 38 to open the jaw recesses 34 to receive a pipe and coupling to be compressed and, upon release of the jawarm members, spring 38 closes the jaw recesses about the pipe and coupling. The drive unit is then actuated for the cam rollers thereon to advance axially forwardly of the jaw set and simultaneously engage against cam surfaces 36 to displace jawarm members 12 about pins 18 for jaw recesses 34 to compress the pipe and coupling together. Thereafter, the drive unit is actuated to withdraw the cam rollers, and the jawarm members are again manually displaced against the bias of spring 38 to open the jaw recesses for removal of the jaw set from the compressed pipe and coupling. As indicated in FIG. 3 by broken lines A, B and C, failure in such prior art jawarm members typically occurs, unpredictably, across the jawarm member between the inner and outer edges thereof in any one of the three areas, namely forwardly of pin hole 24 and between the jaw recess and outer edge, behind pin opening 24 and between the outer edge and spring retaining shoulder 32*a* on the inner edge, and at a location further behind the pin opening and between the outer edge and mounting pin clearance recess 32*b* in the inner edge. While areas A, B and C are not shown on both jawarms, it will be appreciated that breakage can occur in either arm and not necessarily in the same area. Moreover, the area of breakage will vary for different arm sizes and different structures or profiles.

Figure 4:
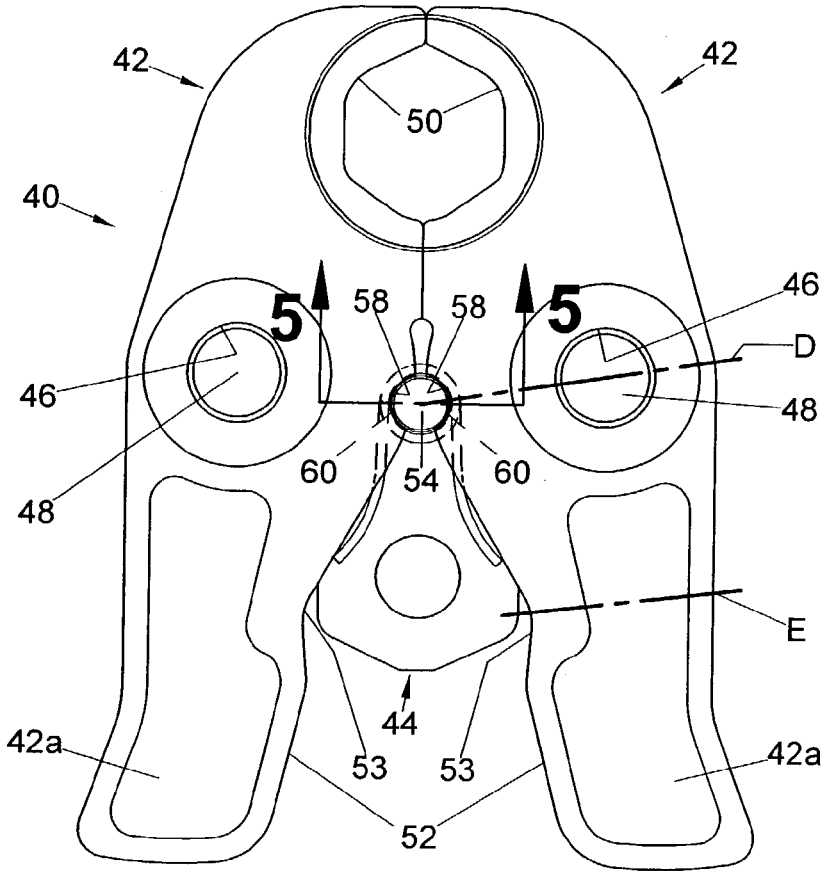
FIG. 4 (PRIOR ART)
FIG. 4 is a plan view of another prior art jaw set with the top side plate removed.
Figure 5:
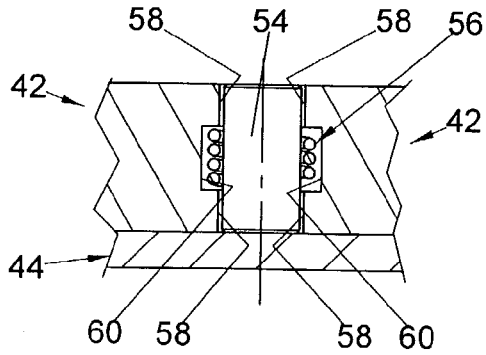
FIG. 5 (PRIOR ART)
FIG. 5 is a sectional elevation view taken along line 5—5 in FIG. 4.

The jawarm members referred to hereinabove as having been tested to the failure point are shown in U.S. Pat. No. 6,434,998 to Amherd and in FIGS. 4 and 5 herein as part of a jaw set 40 comprised of jawarm members 42 which are structurally similar to jawarm members 12 described hereinabove with the exceptions pointed out hereinafter. With regard to the structural similarities, jawarm members 42 are mounted between a pair of side plates 44, the upper one of which is removed in FIGS. 4 and 5 for clarity. Each of the jawarms 42 has a pivot pin opening 46 between the opposite sides thereof for receiving a corresponding pivot pin 48 and is recessed behind the pin opening as indicated by numeral 42*a*. The inner edge of each jawarm includes a jaw recess 50 at the front end thereof, a cam surface 52 at the rear end, and a mounting pin clearance recess 53 forwardly of the cam surface. With regard to the structural differences as seen in FIGS. 4 and 5, side plates 44 support a spring pin or post 54 about which the closed end of a torsion spring 56 is coiled, and the inner edge of each of the jawarm members is provided with a pin and spring recess including a radially shallow pin recesses 58 adjacent the opposite sides of the jawarm to accommodate the corresponding part of pin 54, and a spring recess 60 intermediate the opposite sides of the jawarm to accommodate the closed end of the torsion spring and the rearwardly extending legs thereof. As mentioned hereinabove, the testing of these jawarms, of different sizes, resulted in 75%–86% of the failures occurring in area D from the pin recess through the pivot pin opening and from 14%–25% across the jawarm in area E. The failures were neither predictable nor controllable, and the failures in area E resulted in fracture of the jawarm into completely separate pieces.

Figure 6:
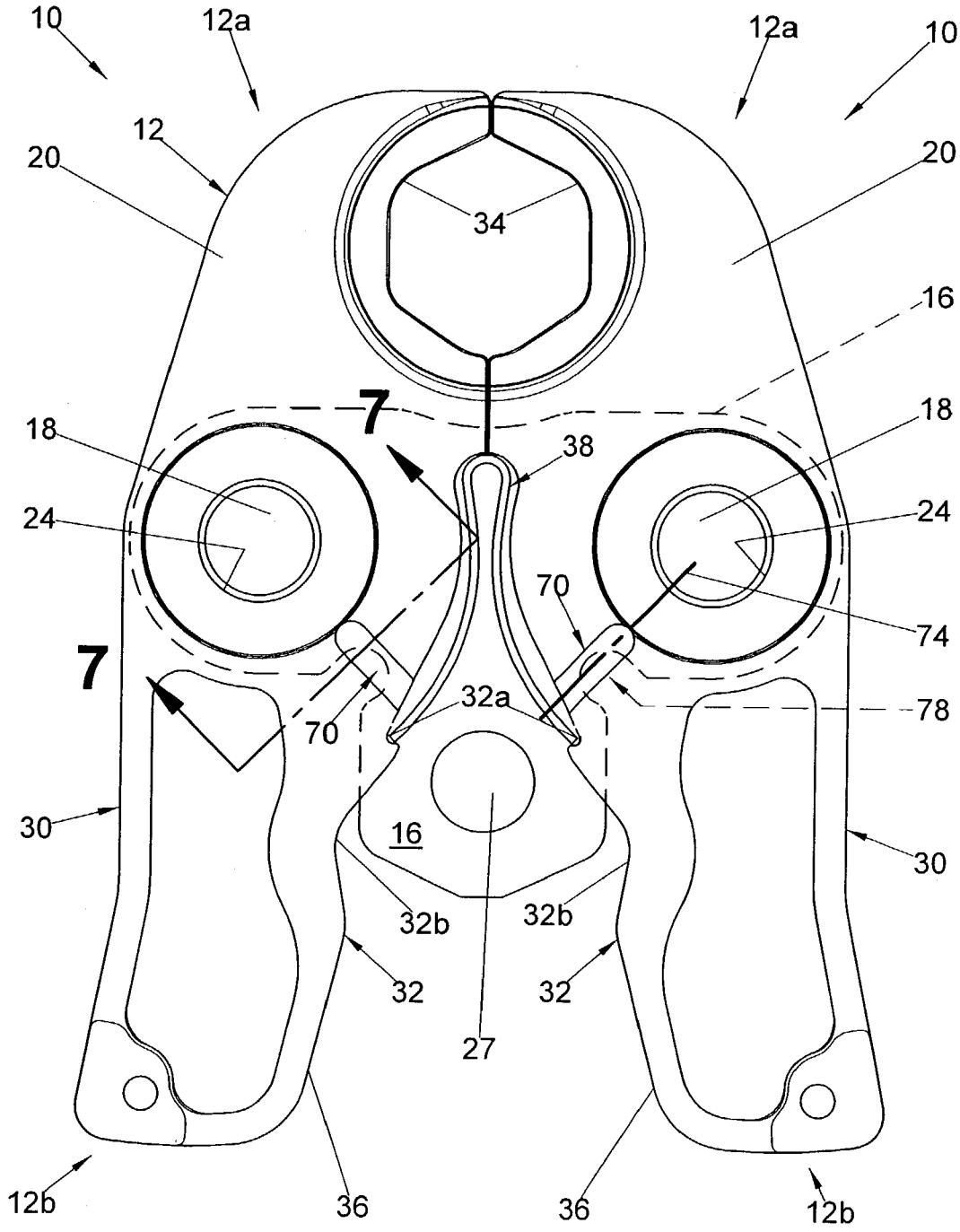
FIG. 6 is a plan view of the jaw set shown in FIG. 1 with the top side plate removed and illustrating the jawarms with a preferred stress concentrator in accordance with the invention.
Figure 7:
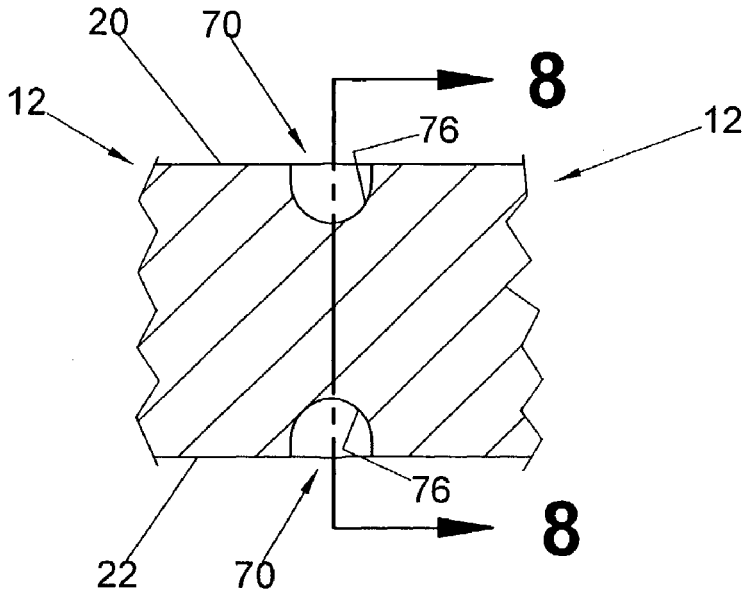
FIG. 7 is a cross-sectional view through one of the stress concentrators taken along line 7—7 in FIG. 6.
Figure 8:
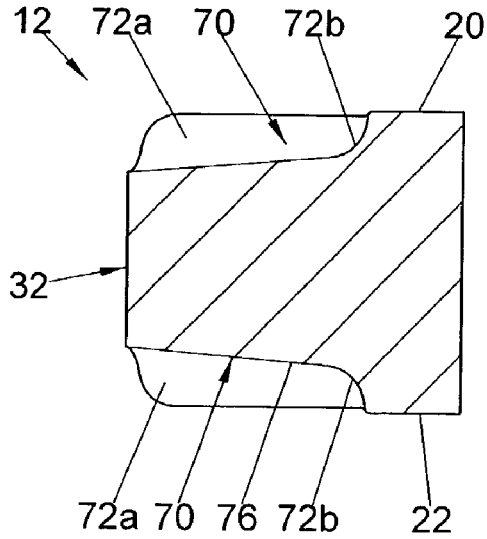
FIG. 8 is a cross-sectional elevation view of the stress concentrator taken along line 8—8 in FIG. 7; and, FIGS. 9A–9F illustrate other embodiments of a stress concentrator in accordance with the invention.

FIG. 6 illustrates jaw set 10 described hereinabove in connection with FIGS. 1–3 modified to have a preferred stress concentrator structure in accordance with the invention. Accordingly, like numerals are used to designate component parts corresponding to those in FIGS. 1–3. As shown in FIGS. 6–8, a preferred stress concentrator in accordance with the invention comprises a recess or channel 70 in each of the opposite sides of the jawarm, which recesses are aligned with one another and extend from inner edge 32 toward the pin opening 24 through the jawarm. Each recess has an outer end 72*a* intersecting edge 32 and an inner end 72*b*, and a line or plane 74 bisecting the recesses between the outer and inner ends thereof preferably extends through the axis of opening 24. Each recess has a bottom 76 providing the recess with a depth relative to the corresponding side of the jawarm member and, preferably, the depth progressively decreases from inner edge 32 of the jaw member toward inner end 72*b* of the recess. The recesses are arcuate in cross-section but could, of course, be rectangular, V-shaped or of other contour. As will be appreciated from FIG. 1 and from the broken line outline of lower side plate 16 in FIG. 6, the side plates include a recess 78 through which a portion of each channel 70 is visible, whereby an operator of the compression tool can visually observe the impending failure of the jawarm as the fracture line progresses along the channels from edge 32 and becomes visible at recess 78. While it is preferred to provide recesses 70 in both of the opposite sides of the jawarm and in alignment with one another, whereby the progression of the line of fracture is visible to the operator of the compression tool regardless of the orientation of the jaw set when mounted on the drive unit, it will be appreciated that a single recess or channel in one side of the jawarm member will function to provide a stress concentrator in accordance with the invention. The use of a recess or recesses to provide a stress concentrator is preferred in that a recess not only provides a failure point along the inner edge of the jawarm at which a fatigue crack is consistently initiated but also because the recess optimizes directing the line of fracture from the failure point across the jawarm and, in connection with the preferred embodiment, to the pivot pin opening through the jawarm. It will be appreciated, of course, that if the stress concentrator is provided by a single recess in one of the opposite sides of the jawarm member, the recess will have a depth sufficient to provide the necessary area of high stress concentration to consistently provide a failure point along inner edge 32 at which the fatigue crack is initiated in connection with breakage of the arm.

In operation, the imposition of laterally outwardly directed forces against cam surfaces 36 of the jawarm members inner edges 32 thereof under tension, and the stress concentrator provides an area of concentrated stress higher than that along the inner edge in any other area thereof under tension. Accordingly, the stress concentrator provides a failure point at which a fatigue crack is initiated each and every time there is a failure. Continued laterally outwardly directed forces against cam surfaces 36, the imposition of which forces is intermittent in connection with repeated use of the compression tool, ultimately causes a fatigue crack at the failure point and then fracture of the jawarm member along the recess from the outer toward the inner end thereof and thence to pivot pin opening 24.

While it is preferred that the channel or recess be directed to the pivot pin opening through the jawarm, it will be appreciated that it can be directed across the arm between the inner and outer edges from any desired location along the inner edge at which the recess will be subject to stress during use of the compression tool.

Figure 9A:
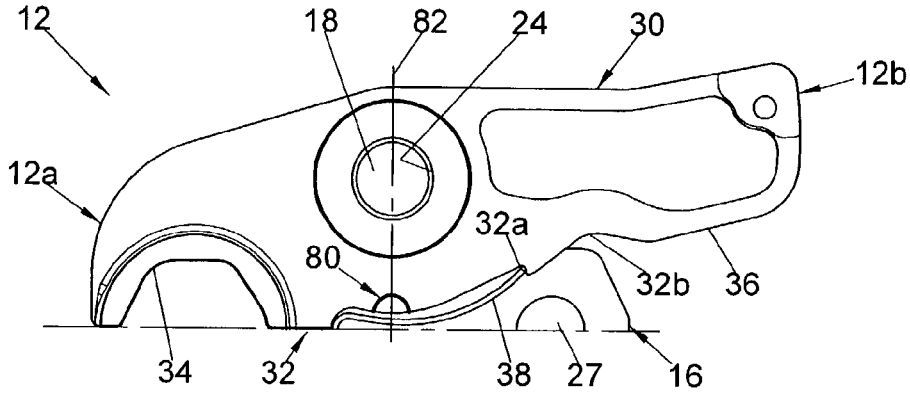
Figure 9B:
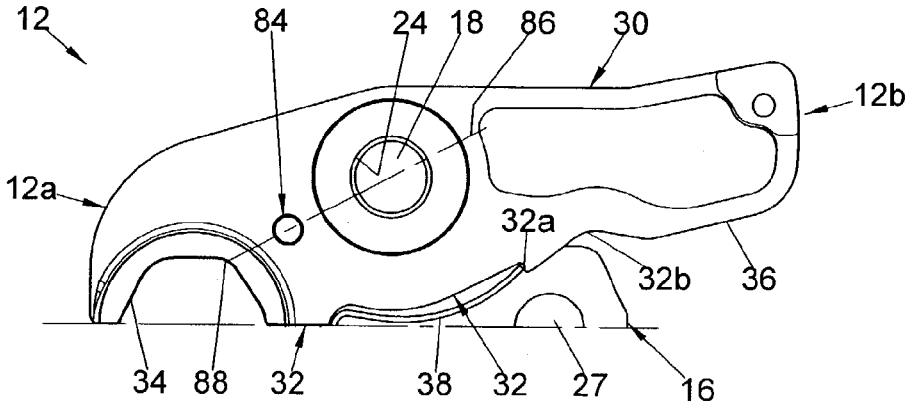

While the preferred stress concentrator is in the form of channels or recesses, it will be appreciated that a wide variety of stress concentrator profiles and orientations relative to the inner and outer edges of a jawarm can provide the desired failure point at the inner edge for consistently initiating a fatigue crack at the failure point and fracture of the jawarm from the failure point toward the outer edge. A number of stress concentrators for providing the latter predictability and control with respect to the failure of a jawarm in accordance with the invention are depicted in FIGS. 9A–9F of the drawing in association with a jawarm 12 corresponding structurally to jawarms 12 in FIG. 6. More particularly in this respect, stress concentrator 80 shown in FIG. 9A is an arcuate recess between the opposite sides of the jawarm and extending into jawarm from inner edge 32 toward pivot pin opening 24 as indicated by a reference line 82 bisecting the arcuate recess. It will be appreciated that the contour or profile of the recess together with the direction thereof and the depth thereof relative to inner edge 32 provide a point of high stress concentration and thus a failure point at the inner edge for consistently initiating a fatigue crack at the failure point and fracture of the jawarm from the failure point to opening 24. In FIG. 9B, the stress concentrator 84 is provided by a hole or bore through the jawarm between the opposite sides thereof and oriented relative to opening 24 for a reference line 86 bisecting the opening and bore to intersect jaw recess 34 to provide a failure point 88 at which a fatigue crack is initiated upon failure and fracture of the jawarm from failure point 88 to opening 24. This location is of advantage because of the visibility thereof. At the same time, it will be appreciated that the bore providing stress concentrator 84 can be located between edge 32 and outer edge 30 of the jawarm anywhere in the area along edge 32 which is under tension during use of the compression tool. It will be appreciated that the bore can be used in combination with, channel structure shown in FIGS. 6–8 as well as with others of the stress concentrator shown in FIGS. 9A and 9C–9F.

Figure 9C:
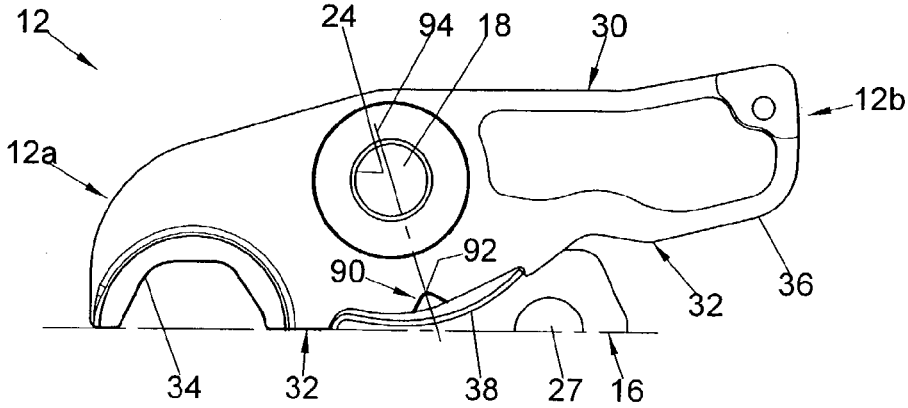
Figure 9D:
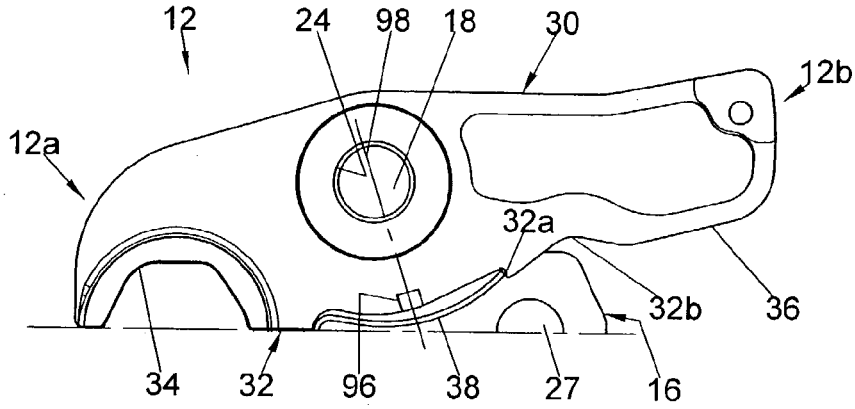
Figure 9E:
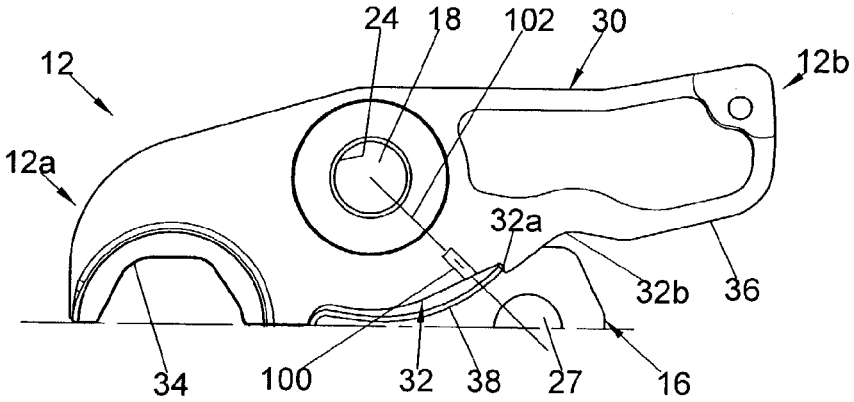
Figure 9F:
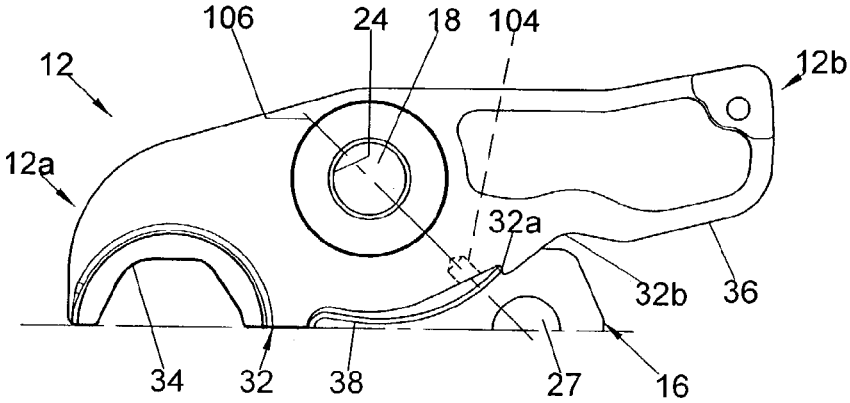

In FIG. 9C, stress concentrator 90 is a V-shaped notch between the opposite sides of the jawarm and having linear sides intersecting at a vertex 92 spaced inwardly from edge 32 and directed toward opening 24 as indicated by a reference line 94 bisecting the notch. In FIG. 9D, the stress concentrator 96 is a rectangular notch between the opposite sides of the jawarm and having linear, parallel sides extending into the jawarm from edge 32 for the notch to be directed toward opening 24 as indicated by reference line 98 between and parallel to the sides of the notch. In FIG. 9E, stress concentrator 100 is a narrow saw cut through the opposite sides of the jawarm and extending toward opening 24 as indicated by reference line 102. The sawcut extends into the jawarm from a point along edge 32 adjacent spring retaining shoulder 32*a* thereon and further illustrates the selectivity with respect to the location of the stress concentrator. In FIG. 9F, stress concentrator 104 is a bore into the jawarm from inner edge 32 and between the opposite sides of the jawarm, and the bore is directed toward opening 24 as indicated by reference line 106 which is the axis of the bore.

As with stress concentrator 80 in the form of an arcuate recess extending into the jawarm from inner edge 32, each of the stress concentrators 90, 96, 100, and 104 will extend into the jawarm to the extent necessary to provide a point of high stress concentration and thus a failure point at the inner edge for consistently initiating a fatigue crack at the failure point and fracture of the jaw from the failure point toward opening 24. While the stress concentrators in FIGS. 9A–9F are all oriented for the line of fracture to extend from the failure point to pivot pin opening 24 as is preferred in accordance with the invention, it will be appreciated that any of the stress concentrators can be located along inner edge 32 and oriented relative to outer edge 30 to provide the failure point at the inner edge for consistently initiating a fatigue crack at the failure point and for directing fracture of the jawarm from the failure point toward the outer edge other than through opening 24. For example, stress concentrator 100 in FIG. 9E could be oriented for reference line 102 to extend between inner and outer edges 32 and 30 along a line spaced rearwardly of opening 24 as represented, for example, by lines B or C in FIG. 3. In this respect it remains that, in accordance with the invention, the stress concentrator provides a failure point at the inner edge for consistently initiating a fatigue crack at the failure point, and the orientation of the stress concentrator relative to the inner and outer edges drives the line of fracture from the fatigue point toward the outer edge. Furthermore, it will be appreciated that any of the stress concentrators shown in FIGS. 9A–9F can be combined with a recess or recesses similar to recesses 70 so as to optimize control of the direction of the line of fracture from the failure point toward the opening or outer edge of the jawarm.

The stress concentrator dimensions depend on a number of variables including the material from which the jawarm is made, heat treatment parameters, the thickness and profile of the jawarm including areas from which material is removed to decrease the cost and/or weight, a selected location for the stress concentrator relative to the inner and outer edges and along the inner edge between the jaw recess and cam surface, and the geometry of the stress concentrator. The materials can include, by way of example only, any one of a variety of steel alloys such as 8620 steel, 9310 steel, X19NiCrMo4 steel, and any alloy carburizing grade steel containing Ni for toughness. The jawarms are generally manufactured either by forging and machining or by casting, such as investment casting, and machining, and various heat treatments can include selective induction hardening, annealing, carburizing, at times with masking to control the carburizing, and the heat treating can involve a draw temperature of from 400° F. to 700° F., for example. In connection with heat treating a jawarm having a stress concentrator in accordance with the invention to provide a failure point at the inner edge of the jawarm from which a fracture line is driven across the arm toward the outer edge thereof upon failure, it is preferred that the heat treatment be such as to enhance ductility of the jawarm in the area along the outer edge thereof towards which the fracture line is driven so that the outer part of the arm which is loaded in bending as it is approached by the fracture line will act as a hinge to retain the two jawarm pieces on opposite sides of the fracture line against total separation. This could be achieved with respect to the jawarms in FIG. 6, for example, by masking the areas of the jawarm laterally outwardly of pivot pin opening 24 therethrough to prevent carburizing in the masked area, or by annealing those areas of the jawarms after carburizing.

With respect, for example, to designing a jawarm for the jaw set shown in FIG. 6, to have a stress concentrator in accordance with the present invention, and in particular the stress concentrator to a desired jawarm life, material, and a processing and heat treatment methodology is chosen. With regard to part life, for example, 10,000 cycles may be considered to be the minimum acceptable jawarm life. Because of the variability of fatigue data, an expected life higher than 10,000 cycles is generally sought. The life finally chosen depends on a variety of factors including the type of steel to be used and the elected heat treatment process from, for example, carburizing, through hardening, induction hardening, carbon enhancement, carboaustemper, and factors such as surface hardness, core hardness, and the like. Additionally, the part life is dependent in part on the processing of the chosen steel by, for example, investment casting, forging, bar stock, machining, and factors including surface finish, part repeatability, and the like. Once the part life and a material, processing and heat treatment methodology are determined, an appropriate maximum design stress level can be determined for the jawarm. For example, for a life of 11,000+ cycles, using AISI 8620 steel made from bar stock or a forging, and carburized with a 650° F. draw temperature, a maximum design stress in the stress concentrator channel area was set at 220 ksi. The latter determination is made through a combination of available book values for strength and endurance limit, testing, and past experience. Once the maximum design stress is determined, the location of the failure point along the inner edge of the jawarm is chosen, and this failure point can be anywhere from the crimp area at the front end of the jawarm to the cam surface area at the rear end thereof. In any event, a starting point for the stress concentrator which is forwardly or rearwardly of the side plates of the jaw set or a starting point as shown in FIG. 6 is preferred in that, when a break does occur, the operator can visually observe the same. In the preferred embodiment shown in FIG. 6, the stress concentrator is a channel-shaped recess or depression in one or both sides of the jawarm that starts at the tensile loaded inner edge of the jawarm and is oriented toward the pivot pin hole. The recess or channel does not need to go all the way to the pivot pin hole, although it could. The size of the channel is determined by the dimensions needed to form the channel, such as a machine tool or forge die radii, and the depth of the recess or recesses is determined by the amount of material which has to be removed, or the part thinning required, to increase the stress to the maximum design stress at the tensile loaded inner edge which, in the present example, is about 220 ksi. Once the stress concentrator is located and preliminarily sized, the rest of the jawarm can be sized. In this respect, typically, material is added or removed as required so that the stress in the rest of the jawarm is at least 25% lower than at the failure point and stress concentrator. This is done to assure that breakage initiates at the failure point along the inner edge of the jawarm and nowhere else. At this point, the basic design is complete and prototypes are made and tested to confirm that the design parameters provide the desired results upon failure of the jawarm.

As will be appreciated from the description above regarding the force concentrators shown in FIGS. 9A–9F and the design of the stress concentrator shown in FIG. 6, the jawarm shown in FIGS. 4 and 5 can be modified for the pin recess therein to provide a stress concentrator in accordance with the present invention. In this respect, the recess can be enlarged radially inwardly forward opening 46 and/or material can be added in area E of the jawarm so that the stress at the pin recess is high enough to assure that the failure point is always at the pin recess.

While considerable emphasis has been placed on the preferred embodiments herein illustrated and described, it will be appreciated that other embodiments of the invention can be made and that many changes can be made in the preferred embodiments without departing from the principals of the invention. Accordingly, it is to be distinctly understood that the forgoing descriptive matter is to be interpreted merely as illustrative of the invention and not as a limitation.

Having thus described the invention, it is so claimed:

1. A jawarm for a compression tool, said jawarm having opposite sides, an opening therethrough, longitudinally opposite ends on longitudinally opposite sides of said opening, inner and outer edges between said ends and on laterally opposite sides of said opening, and a stress concentrator in said jawarm along said inner edge and providing a failure point at said inner edge for consistently initiating a fatigue crack at said failure point and fracture of said jawarm from said failure point toward said opening.

2. A jawarm according to claim 1, wherein said stress concentrator includes a notch having linear sides extending into said jawarm from said inner edge toward said opening.

3. A jawarm according to claim 2, wherein said linear sides of said notch are parallel and spaced apart in the direction between said opposite ends.

4. A jawarm according to claim 1, wherein said stress concentrator includes a V-shaped notch having linear sides intersecting at a vertex spaced inwardly of said inner edge.

5. A jawarm according to claim 1, wherein said stress concentrator includes an arcuate recess extending into said jawarm from said inner edge.

6. A jawarm according to claim 1, wherein said stress concentrator includes a hole through said opposite sides between said inner edge and said opening.

7. A jawarm according to claim 1, wherein said stress concentrator includes a bore extending inwardly from said inner edge toward said opening and between said opposite sides.

8. A jawarm according to claim 1, wherein said stress concentrator includes a recess in at least one of said opposite sides extending in the direction from said inner edge toward said opening.

9. A jawarm according to claim 8, wherein said stress concentrator includes a recess in each of said opposite sides.

10. A jawarm according to claim 9, wherein the recesses in said opposite sides are aligned with one another.

11. A jawarm according to claim 8, wherein said recess has an outer end intersecting said inner edge.

12. A jawarm member according to claim 11, wherein said stress concentrator includes a recess in each of said opposite sides.

13. A jawarm according to claim 12, wherein the recesses in said opposite sides are aligned with one another.

14. A jawarm according to claim 8, wherein said recess has an inner end spaced from said inner edge and a depth relative to said one side, said depth progressively decreasing in the direction from said inner edge toward said inner end.

15. A jawarm according to claim 14, wherein said recess has an outer end intersecting said inner edge.

16. A jawarm according to claim 8, wherein said stress concentrator includes a recess in each of said opposite sides, each said recess having an inner end spaced from said inner edge and a depth relative to the corresponding one of said opposite sides.

17. A jawarm according to claim 16, wherein the depth of each recess progressively decreases in the direction from said inner edge to the inner end of the recess.

18. A jawarm according to claim 17, wherein the recesses in said opposite sides are aligned with one another.

19. A jawarm according to claim 18, wherein each of the recesses has an outer end intersecting said inner edge.

20. A jawarm according to claim 16, wherein each said recess is arcuate in cross-section.

21. A pivotal jawarm for a compression tool, said jawarm having opposite sides, an opening therethrough, longitudinally opposite ends on longitudinally opposite sides of said opening, inner and outer edges between said ends and on laterally opposite sides of said opening, and a stress concentrator in said jawarm between said inner edge and said opening and providing a failure point at said inner edge for consistently initiating a fatigue crack at said failure point and fracture of said jawarm from said failure point to said opening.

22. A jawarm according to claim 21, wherein said stress concentrator includes a notch having linear sides extending into said jawarm from said inner edge toward said opening.

23. A jawarm according to claim 22, wherein said linear sides of said notch are parallel and spaced apart in the direction between said opposite ends.

24. A jaw member according to claim 21, wherein said stress concentrator includes a V-shaped notch having linear sides intersecting at a vertex spaced inwardly of said inner edge toward said opening.

25. A jawarm according to claim 21, wherein said stress concentrator includes an arcuate recess in said inner edge extending toward said opening.

26. A jawarm according to claim 21, wherein said stress concentrator includes a hole through said opposite sides between said opening and said inner edge.

27. A jawarm according to claim 21, wherein said stress concentrator includes a bore extending inwardly from said inner edge toward said opening and between said opposite sides.

28. A jawarm according to claim 21, wherein said stress concentrator includes a recess in at least one of said opposite sides between said opening and said inner edge.

29. A jawarm according to claim 28, wherein said stress concentrator includes a recess in each of said opposite sides.

30. A jawarm according to claim 29, wherein the recess in said opposite sides are aligned with one another.

31. A jawarm according to claim 28, wherein said recess has an outer end intersecting said inner edge.

32. A jawarm according to claim 31, wherein said stress concentrator includes a recess in each of said opposite sides.

33. A jawarm according to claim 32, wherein the recesses in said opposite sides are aligned with one another.

34. A jawarm member according to claim 28, wherein said recess has an outer end intersecting said inner edge, an inner end spaced from said inner edge and a depth relative to said one side, said depth progressively decreasing in the direction from said inner edge toward said inner end.

35. A jawarm according to claim 28, wherein said stress concentrator includes a recess in each of said opposite sides, said recesses being aligned with one another, and each said recess having an inner end spaced from said inner edge and a depth relative to the corresponding one of said opposite sides.

36. A jawarm according to claim 35, wherein the depth of each recess progressively decreases in the direction from said inner edge to the inner end of the recess.

37. A jawarm according to claim 36, wherein each of the recesses has an outer end intersecting said inner edge.

38. A jawarm according to claim 37, wherein each said recess is arcuate in cross-section.

39. A compression tool comprising, a pair of parallel spaced apart side plates having front and rear ends and laterally opposite sides, aligned holes through said plates at each of said opposite sides, a pair of jawarms between said plates, each said jawarm having an opening therethrough aligned with the holes through a different one of said opposite sides, each said jawarm being pivotally mounted between said plates by a pin extending through the opening therethrough and the corresponding aligned holes through said side plates, each said jawarm having inner and outer edges laterally spaced from the opening therethrough and extending forwardly and rearwardly of the opening therethrough, said inner edges providing laterally inwardly open opposed jaw recesses forwardly of said front ends of said side plates and laterally inwardly facing cam surfaces rearwardly of said rear ends of said side plates, the jawarms during use of the compression tool being pivoted about said pins in response to forces laterally outwardly against said cam surfaces to displace said jaw recesses laterally inwardly to compress an object therebetween, whereby an area of each jawarm between the opening and inner edge thereof and between the cam surface and jaw recess thereof is under tension, and a stress concentrator in said area of each jawarm for consistently initiating a fatigue crack at a failure point along the inner edge thereof and fracture of the jaw member from said failure point to the opening therethrough.

40. A compression tool according to claim 39, wherein said side plates overlie at least a portion of said areas of the jaw members and at least a portion of said stress concentrator is visible.

41. A compression tool according to claim 39, wherein each jawarm has axially opposite sides and said stress concentrator includes a recess in at least one of said axially opposite sides.

42. A compression tool according to claim 41, wherein said stress concentrator includes a recess in each of said axially opposite sides.

43. A compression tool according to claim 42, wherein the recesses in said axially opposite sides are aligned with one another.

44. A compression tool according to claim 41, wherein said recess has an outer end intersecting said inner edge at said failure point.

45. A compression tool according to claim 44, wherein said outer end of said recess is spaced rearwardly of a plane through the axes of the pins.

46. A compression tool according to claim 45, wherein said stress concentrator includes a recess in each of said axially opposite sides and aligned with one another.

47. A compression tool according to claim 46, wherein said side plates overlie at least a portion of said areas of the jawarms and at least a portion of each stress concentrator is visible.

48. A compression tool according to claim 45, wherein said recess has an inner end spaced from said inner edge and a depth relative to said one side, said depth progressively decreasing in the direction from said inner edge toward said inner end.

49. A compression tool according to claim 48, wherein said recess has an outer end intersecting said inner edge.

50. A compression tool according to claim 45, wherein said stress concentrator includes a recess in each of said axially opposite sides, each said recess having an inner end spaced from said inner edge and a depth relative to the corresponding one of said axially opposite sides.

51. A compression tool according to claim 50, wherein the depth of each recess progressively decreases in the direction from said inner edge to the inner end of the recess.

52. A compression tool according to claim 51, wherein the recesses in said axially opposite sides are aligned with one another.

53. A compression tool according to claim 52, wherein each of the recesses has an outer end intersecting said inner edge.

54. A compression tool according to claim 53, wherein said side plates overlie at least a portion of said areas of the jaw members and at least a portion of the recesses are visible.

55. A method of controlling failure of a pivotal jawarm for a compression tool comprising, producing a jawarm having opposite sides, an opening therethrough, longitudinally opposite ends on longitudinally opposite sides of said opening, and inner and outer edges between said ends and on laterally opposite sides of said opening, reducing the amount of material in an area of said jawarm between said inner and outer edges to produce a failure point at said inner edge for consistently initiating a fatigue crack at said failure point and fracture of said jawarm from said failure point toward said opening.

56. The method according to claim 55, and reducing the amount of material by forming a V-shaped notch in said jawarm having linear sides intersecting at a vertex spaced inwardly of said inner edge and directed toward said opening.

57. The method according to claim 55, and reducing the amount of material by forming an arcuate recess in said inner edge between said opposite sides and directed toward said opening.

58. The method according to claim 55, and reducing the amount of material by providing a hole through said opposite sides of said jawarm on a line from said failure point toward said opening.

59. The method according to claim 58, and reducing the amount of material by forming a notch in said jawarm having linear sides extending from said inner edge and directed toward said opening.

60. The method according to claim 55, and reducing the amount of material by providing a bore in said jawarm extending inwardly from said inner edge toward said opening and between said opposite sides.

61. The method according to claim 55, and reducing the amount of material by forming a recess in at least one of said opposite sides of the jawarm from said inner edge toward said opening.

62. The method according to claim 61, and forming a recess in each of said opposite sides.

63. The method according to claim 62, and forming the recesses in said opposite sides in alignment with one another.

64. The method according to claim 61, and forming said recess to have an outer end intersecting said inner edge.

65. The method according to claim 64, and forming the recesses in said opposite sides in alignment with one another.

66. The method according to claim 65, and forming the recesses to have an inner end spaced from said inner edge and a depth progressively decreasing in the direction from said inner edge toward said inner end.

67. A jawarm according to claim 1, said jawarm being of steel and having a ductility inwardly adjacent said outer edge providing a hinge area to preclude fracture of said jawarm through said outer edge.

68. A jawarm according to claim 67, wherein said steel is an alloy carbonizing grade steel containing Ni.

69. A jawarm according to claim 67, wherein said steel is one of 8620 steel, 9310 steel, and X19Ni CrMo4 steel.

70. A jawarm according to claim 21, said jawarm being of steel and having a ductility between said outer edge and said opening providing a hinge area to preclude fracture of said jawarm from said opening through said outer edge.

71. A jawarm according to claim 70, wherein said steel is an alloy carbonizing grade steel containing Ni.

72. A jawarm according to claim 70, wherein said steel is one of 8620 steel, 9310 steel, and X19Ni CrMo4 steel.

73. A jawarm according to claim 39, each said jawarm being of steel and having a ductility between the outer edge and the opening therethrough providing a hinge area to preclude fracture of the jawarm from the opening through the outer edge.

74. A jawarm according to claim 73, wherein said steel is an alloy carbonizing grade steel containing Ni.

75. A jawarm according to claim 73, wherein said steel is one of 8620 steel, 9310 steel, and X19Ni CrMo4 steel.

76. The method according to claim 55, further including the steps of producing said jawarm from steel and heat treating said jawarm to produce a ductility inwardly adjacent said outer edge providing a hinge area to preclude fracture of said jawarm through said outer edge.

77. The method according to claim 76, wherein said heat treating comprises masking said hinge area and carbonizing said jawarm.

78. The method according to claim 77, wherein said carburizing is at a temperature of from 400° F. to 700° F.

79. The method according to claim 76, wherein said heat treating comprises carburizing said jawarm and then annealing said hinge area.

80. The method according to claim 76, wherein said steel is an alloy carbonizing grade steel containing Ni.

81. The method according to claim 76, wherein said steel is one of 8620 steel, 9310 steel, and X19Ni CrMo4 steel.

82. A method of designing a compression tool jawarm to have a stress concentrator for controlling failure of the jawarm, comprising designing a jawarm profile having opposite sides, an opening therethrough, longitudinally opposite ends on longitudinally opposite sides of said opening, and inner and outer edges between said ends and on laterally opposite sides of said opening, choosing a jawarm life in cycles of operation, choosing a steel for the jawarm, selecting a heat treating process for the jawarm, selecting a maximum stress level for failure of the jaw arm, selecting a location along the inner edge for the stress concentrator, designing the stress concentrator to provide a failure point at the inner edge for initiating a fatigue crack at the selected maximum stress and fracture of the jawarm from the failure point toward the opening, and sizing the remainder of the jawarm to have a stress level less than the selected maximum stress level.

83. The method of claim 82, including the further steps of producing a prototype of the designed jaw arm and the testing prototype.

* * * * *